United States Patent [19]

Pedraza

[11] 4,127,214

[45] Nov. 28, 1978

[54] HINGE ASSEMBLY FOR CONTAINER DOORS

[76] Inventor: Rafael Pedraza, 840 SE. 8th Ct., Hialeah, Fla. 33010

[21] Appl. No.: 861,536

[22] Filed: Dec. 19, 1977

[51] Int. Cl.[2] ..... B65D 43/14; B65D 51/04

[52] U.S. Cl. ..... 220/334; 220/1.5; 16/163

[58] Field of Search ..... 220/1.5, 331, 332, 333, 220/334, 335; 16/163, 179

[56] References Cited

U.S. PATENT DOCUMENTS

| | | | |
|---|---|---|---|
| 3,300,265 | 1/1967 | Wilmer et al. | 220/334 X |
| 3,672,529 | 6/1972 | Feddersen et al. | 16/179 X |
| 3,706,392 | 12/1972 | Sprick et al. | 220/333 |
| 3,832,756 | 9/1974 | Lew | 16/163 |
| 3,860,138 | 1/1975 | Lovich et al. | 220/1.5 |

*Primary Examiner*—George T. Hall
*Attorney, Agent, or Firm*—Jack E. Dominik

[57] ABSTRACT

A hinge assembly and method for opening and closing for a cargo container door is disclosed which maximizes the accessible area to the container and minimizes the clearance needed to open and close the door. The result is accomplished by means of a double action hinge whereby a spacing member is pivotally connected to the top of a cargo container and to the door of said container, the spacing member providing the means to open the door with smaller clearance on the top and also providing the means to allow the door to come to rest on the top of the container in a statically stable condition. A strap assembly and guiding and locking members are also disclosed which are used in performing the method of opening the door of a cargo container disclosed herein and also claimed.

4 Claims, 7 Drawing Figures

HINGE ASSEMBLY FOR CONTAINER DOORS

FIELD OF INVENTION

The present invention relates to door hinges, and more particularly to door hinges for doors on cargo containers which must be constructed to provide as large an access space as possible. The invention also relates to the method of opening and closing cargo container doors and the means for locking the same.

DISCUSSION OF PRIOR ART

The oldest means known to open container doors is to simply put hinges at the horizontal axis of rotation which is coincident with the top of a container. The primary problem with this "trap door" means is that it is extremely difficult for a single operator to open the door fully without letting it drop on top of the container. This results in damage to the container which is made out of thin light weight material. A further problem is that there must be a clearance above the container of at least the size of the door so that the door can gyrate and come to rest on the top of the container. In cargo containers used in aircraft the clearance needed to open the container must be minimized in order to use the small volume available inside transport aircraft to the fullest.

Presently, in one prior art scheme the door panels of cargo containers are secured by an inwardly attached hinge which is connected to a hingedly attached sliding member. This sliding member fits into a channel built inside the cargo container door, and serves to guide the door as it slides inwardly onto the top of the container. This mechanism has suffered from a number of shortcomings. First, when the container doors are closed, the compound hinge remains inside, taking up valuable space that could be used for cargo. Second, the hinge that is now used can not satisfactorily take the bending and shear stresses that are encountered in the normal opening and closing operations of the door. The result is that these hinges become warped and bent and cease to function properly. Yet another deficiency of the presently used hinge is that the sliding member sometime does not slide freely because of dirt or other foreign matter. This "snagging" increases the time that is required to open the cargo container doors, which in the transport industry translates into increased costs.

Double action hinges have been used in the past for swinging doors (B. F. Barker, U.S. Pat. No. 68,150) folding doors (Lew, U.S. Pat. No. 3,832,756), Craker Boxes (Westerbeck, U.S. Pat. No. 783,003) and lids for jars of steam tables (Quarter, U.S. Pat. No. 1,431,288). In none of these applications is there described the use of the elements between the hinges as a spacing member to position the door or top of a container.

SUMMARY

The present invention is directed towards a container, a door and a double action means and method for opening the door about a horizontal axis on the top of the container. The double action means provides a set off when the door is in the open position so that the door is stable and can not be closed by slight jarring or accidental impact. Also by letting the door rest on the top of the container the opening of the container will be easily accessible.

The double action means comprises primarily a spacing member which is hinged at one end to the top of the container and at the other end to a connecting member. The connecting member is in turn attached to the door which can be a single panel or alternatively a twin panel door hinged at the center.

Accordingly, it is the primary object of this invention to provide a means for opening a cargo container door, or any door hinged at the top, such as a cargo container door, in a quick and reliable manner.

Another object of the present invention is to provide for means for opening the cargo container door that is capable of withstanding the loads generally placed on such doors and the rough treatment they generally receive.

Still another object of the present invention is to provide for a hinge means that is in the exterior of the container yet it is flush to the container thereby maintaining substantially the same exterior volume, while increasing the available interior volume.

Yet another object of the present invention is to provide for a hinge means of opening a container door that results in the door being placed in a statically stable condition on top of the container, thereby providing easy access to the container.

An important object of the present invention is to provide a means for opening the door of a large container, so that one person standing in front of the container can open the same without changing his position, and can so open the door in a relatively confined space. The clearance above the container need only be slightly larger than the spacing member described below.

DESCRIPTION OF DRAWINGS

Further objects and advantages of the present invention will become apparent as te following description of an illustrative embodiment proceeds, taken in conjunction with the accompanying drawings in which.

DESCRIPTION OF PREFERRED EMBODIMENT

Figure 1:
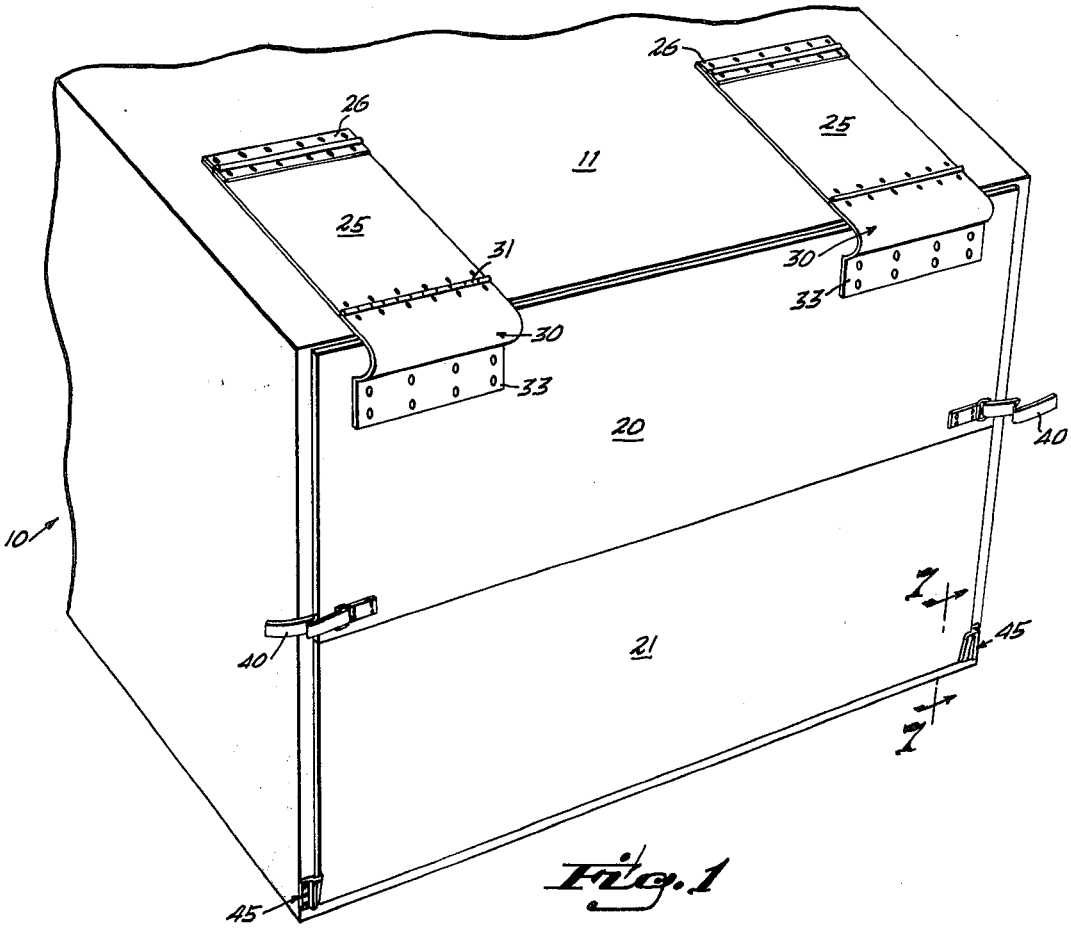
FIG. 1 is an oblique front view of a cargo container with the double action means and twin panel doors.

The invention is best initially described by viewing FIG. 1. There a cargo container 10 is shown with a two panel door 20 and 21. On the top of the container 11 there is a spacing member 25 which is hingedly secured to the top of the container 11 at 26. The spacing member is also hingedly attached to a curvilinear connecting member 30. The curvolinear connecting member is designed to prevent any interference between the door and the top of the container when the door is being opened. In the drawing the guiding and locking member 45 is shown as it appears when the door 20 and 21 is in the locked position.

Figure 2:
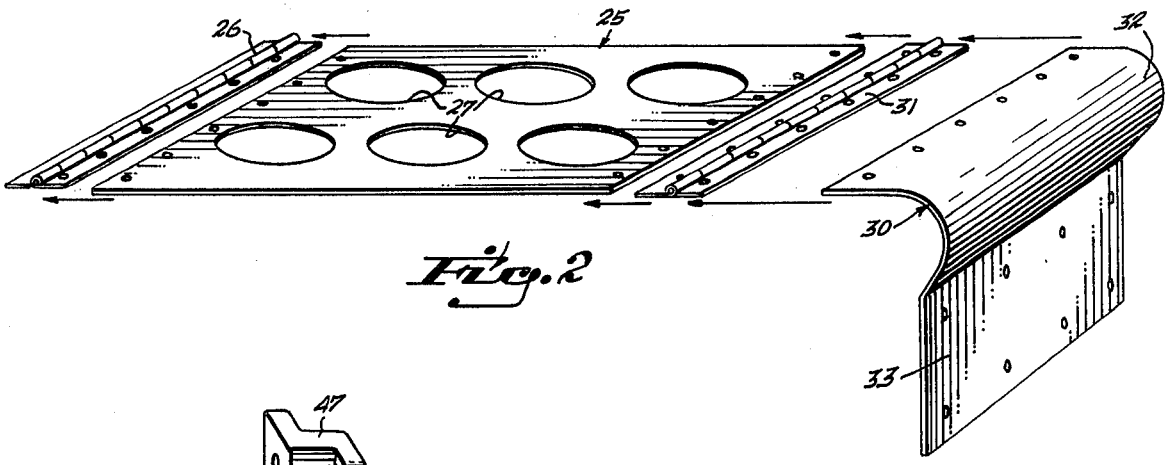
FIG. 2 is an exploded perspective view of the double action means or hinge.

Turning now to FIG. 2, the double action means is shown in an exploded view. A hinge 26 is shown together with a spacing member 25 to which the hinge is attached. A pluality of holes 27 are shown which in the preferred embodiment serve to lessen the weight of the invention. The hinge 31 which pivotally attches the spacing member 25 and the connecting member 30 is also shown. The connecting member 30 is shown in the preferred embodiment having a curved portion 32 and a planar portion 33. The purpose of the curved and planar portions is to provide for a spacial relationship between the pivoting point and the door so that when the door is open and closed there is no interference with the top of the container. Furthermore the curved portion provides a strong structural member which is not easily susceptible to bending under stress.

Figure 3:
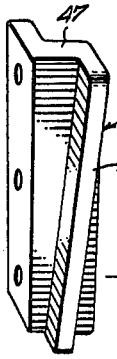
FIG. 3 is a side view of the guiding and locking member.
Figure 7:
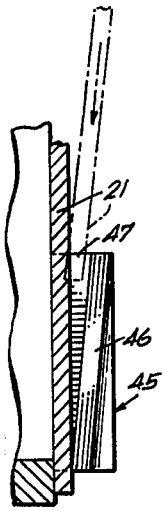
FIG. 7 is a side view of the guiding and locking means and its operation in conjunction with the door.

The guiding and locking member 45 is best shown in FIG. 3. There it is seen that it comprises an L-shaped member 47 and an angularly displaced cantilevered member 46. The angularly displaced cantilevered member serves to guide the door as it is being closed, and also serves to secure it at the bottom when it is in the closed position. (FIG. 7)

Figure 4:
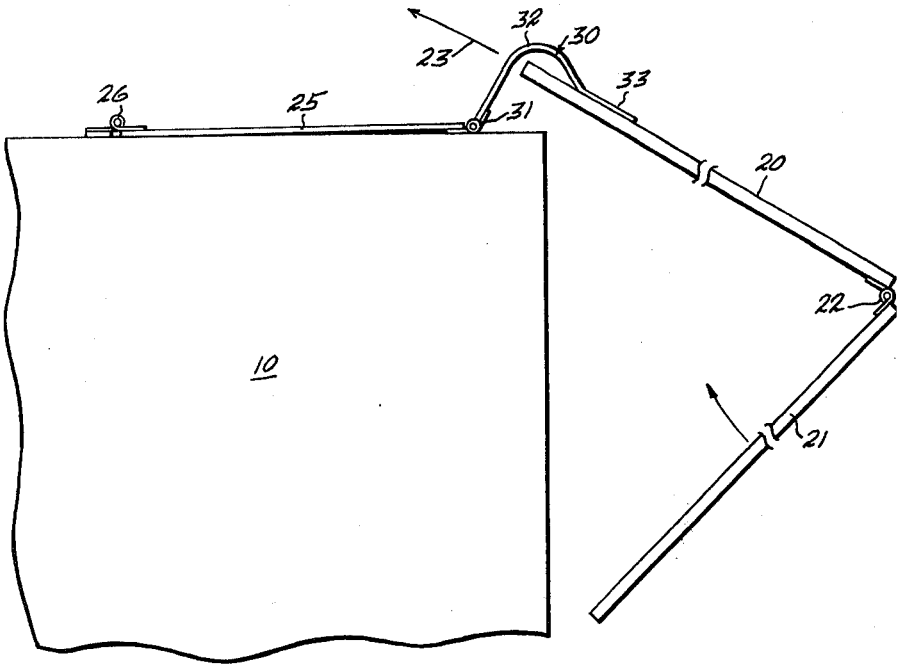
FIGS. 4, 5, and 6 are a sequential side view of the operation of the double action means.
Figure 5:
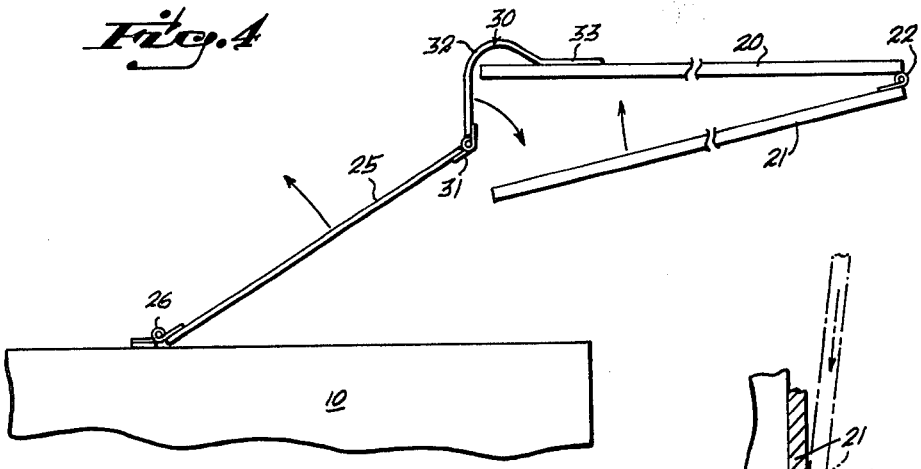
Figure 6:
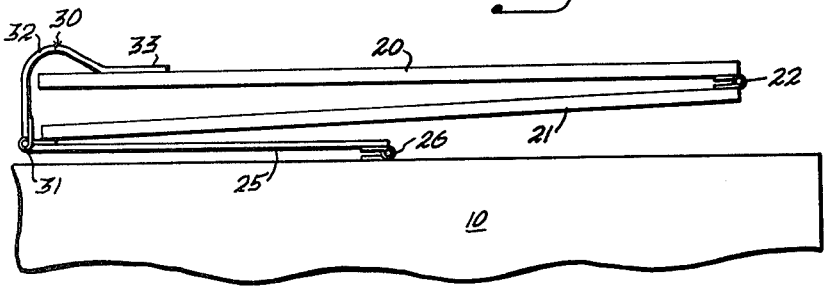

The operation of the invention can best be illustrated by the sequential representation shown in FIGS. 4, 5, and 6. FIG. 4 shows the initial step of the operation. The door 20, 21, is pulled outwardly by pulling on the straps 40 causing the panels 20 and 21 to pivot about the door's centrally situated hinge 22. The bottom door panel 21 is then rotated upwardly somewhat. The hinge 31 is so designed as to have a conterclockwise angle of rotation of less than or equal to 90°, from its normally closed position. When the door is rotated about hinge 31 to itx maximum angle of rotation, the continued lifting then causes the doors, and the spacing member 25 to rotate about hinge 26. The operator then pushes on door panel 20 along the vector described by the side view cross-section of the door panel 20, this vector is described in FIG. 4 as number 23. This upward force causes the spacing member 25 to rotate above the hinge 26. While this rotation is taking place the operator finishes placing the bottom door panel 21 directly below and coincident to the door panel 20. The operator then pushes the two panels 20 and 21 in a direction substantially horizontal, to cause the spacing member 25 to continue to rotate about its axis at 26 and cause the connecting member 30 to rotate about the spacing member 25 at its hinge 31. The spacing member will rotate counterclockwise with respect to its axis at the hinge 26, and the connecting member will be rotating clockwise with respect to the axis at the hinge 31. When the spacing member 25 has gone through a 180° rotation, the door panels 20 and 21 will come to rest on the top of the container 10.

The length of the spacing member in the preferred embodiment is determined by the height and weight of the door panels and the weight and rotation of the spacing member and connecting member. The minimum length is that which would provide for a static equilibrium of the door panels 20 and 21 and spacing and connecting members 25 and 30, when the same overhang the container 10. This can be calculated from a weight and moment equation.

What is claimed is:

1. A double action hinge for opening a door to a container comprising:

a spacing member having one end pivotally connected to the top of said container, a curvilinear member having one end pivotally connected to the other end of said spacing member, said door fixedly secured at the top thereof to the other end of said curvilinear connecting member.

2. A method of opening a door of cargo container with the use of a spacing member comprising the steps of:

pivoting the door about its top, pushing the door in an upward direction and along the plane of the door so as to cause the spacing member to rotate about the top of the container, continued pushing in upward direction along the plane of the door thereby causing the spacing member to pivot about the top of the door and the top of the container simultaneously and further causing the spacing member to rotate to an angle greater than 90° about the pivot point between the top of the container and the spacing member, placing the door partially on top of the spacing member and partially on top of the container so that the door in is a statically stable condition.

3. The double action hinge of claim 1, wherein said door comprises:

two panels pivotally attached one to the other, whereby the door can be folded at the center.

4. A hinge for opening and securing the door to a container comprising:

a flat spacing member one end of which is pivotally secured to the top of a container, a curvilinear connecting member, pivotally attached to the said flat spacing member, a top door panel the top of which is pivotally attached to said curvilinear connecting member, a bottom door panel the top of which is pivotally attached to the bottom of said top door panel, a guiding member securedly attached to said container whereby said door can be guided to a tightly closed position, means for locking one of said door panels to the container.

* * * * *